US007427207B2

(12) United States Patent
Jackson, III

(10) Patent No.: US 7,427,207 B2
(45) Date of Patent: Sep. 23, 2008

(54) ADJUSTABLE FEED THROUGH BUSHING BASE

(76) Inventor: Denton L. Jackson, III, 9184 Highway 51, Coldwater, MS (US) 38618

( * ) Notice: Subject to any disclaimer, the term of this patent is extended or adjusted under 35 U.S.C. 154(b) by 0 days.

(21) Appl. No.: 11/494,377

(22) Filed: Jul. 27, 2006

(65) Prior Publication Data

US 2008/0026636 A1 Jan. 31, 2008

(51) Int. Cl.
*H01R 4/66* (2006.01)

(52) U.S. Cl. ..... 439/181; 439/921; 439/534

(58) Field of Classification Search ..... 439/181, 439/921, 534, 182–187, 480
See application file for complete search history.

(56) References Cited

U.S. PATENT DOCUMENTS 4,203,641 A * 5/1980 Siebens ..... 439/339
4,787,855 A * 11/1988 Finke ..... 439/92
4,820,183 A * 4/1989 Knapp et al. ..... 439/310
4,891,016 A * 1/1990 Luzzi et al. ..... 439/183
4,921,433 A * 5/1990 Biren ..... 439/534
4,946,394 A * 8/1990 Knapp et al. ..... 439/157
4,955,823 A * 9/1990 Luzzi ..... 439/507
5,427,538 A * 6/1995 Knapp et al. ..... 439/157
6,296,497 B1 * 10/2001 Xu ..... 439/89

* cited by examiner

*Primary Examiner*—Gary F. Paumen
(74) *Attorney, Agent, or Firm*—Charles F. Rye

(57) ABSTRACT

This invention relates to providing a means to removeably mount a feed through/grounding bushing commonly used to bond together, ground and/or park power distribution cables. Many pieces of power distribution equipment have U brackets for removable attachment of accessories and temporary placed maintenance equipment. The present invention addresses holding the bushing at an angle relative to the U bracket and surrounding surface and adjustability of the bushing height relative to the U bracket for strain relief and adjusting for improved work room. Also addressed is the advantage of cable identification by numbering the wells so that a lineman may readily select the cables even after the bushing may have been set aside for equipment replacement. This is especially useful on but not limited to this invention since the U bracket mounting means is moveable and would not always provide positive identification of one end of a multi well bushing. Further provided is the method of grounding the lines of a multi phase system on a common bushing in order that a lineman can rely that the entire phase system is grounded and is gives rapid visual confirmation.

8 Claims, 5 Drawing Sheets

ADJUSTABLE FEED THROUGH BUSHING BASE

BACKGROUND OF THE INVENTION

This invention relates to providing a means to removeably mount a bushing commonly used to bond together, ground and/or park power distribution cables. It is often necessary for lineman to take power distribution equipment offline and safety ground the associated power cables. This has been accomplished by temporarily mounting a multi well bushing on a U bracket commonly found on most distribution equipment. This operation is often done one line at a time on a two well bushing. Previously available grounding bushings bases normally mounted parallel to the face of the U bracket or its surrounding surface and did not provide any adjustability in relation to the U bracket. The present invention addresses holding the bushing at an angle relative to the U bracket and surrounding surface and adjustability of the bushing height relative to the U bracket for strain relief and adjusting for improved work room.

Temporarily mounted multi well bushings for bonding cables together and especially for grounding are known in the art. U.S. Pat. No. 4,787,855 issued to Finke in 1988 claims a multi well bushing with a U bracket mount with one of the wells providing load breaking and receiving a grounding elbow. 855 further provides for insert wells that allow exchange of the bushing well itself and a three well bushing having a triangular foot print.

U.S. Pat. No. 4,921,433 issued to Biren in 1990 addresses a method of locking a bushing base in place by clamping pressure exerted directly on the U bracket itself and not by an eye bolt dependent on its surrounding surface. 433 would allow rotation of the bushing bracket however, it does not address the need and advantage to vary the height of the bushing relative to the U bracket.

SUMMARY OF THE INVENTION

The present invention relates to bonding/grounding and parking power distribution lines associate with power distribution equipment. Many forms of power distribution equipment including but, not limited to, transformers and especially pad mount underground equipment or switching cabinets have U brackets affixed to surfaces on the distribution equipment for both long term and temporary mounting of devices for service use or maintenance. The present invention is an apparatus which mounts into a U bracket and holds a feed through bushing commonly used in power distribution and/or maintenance at an angle other than parallel to the U bracket or the surface it is mounted on. The bushing provides continuity between each power line plugged into its wells to pass power through or especially for safety in maintenance one well will be cabled to ground.

The present invention provides a bushing mounting plate and bushing mounting means to mount a feed through bushing on the front of a bushing mounting plate and affixed to the back is an angle bracket channel having a base and two sides with an elongated aperture along a significant portion of its base. A U bracket engaging means along with a co-mounted position fixing bracket is slide-ably fastened to the apparatus by way of the elongated aperture and a fastener. The position fixing bracket includes an affixed nut opposite the carriage bolt aperture which accommodates an eye bolt with a dome nut on its end. The eye bolt is advanced to engage the dome nut on the U bracket or surrounding surface to provide a positive location of the bushing. By manipulating the U bracket engaging means with the position fixing bracket assembly the height position or clocking of the bushing relative to the U bracket can be altered. In an alternative embodiment the angle bracket channel extends beyond the bushing mounting plate to allow the bushing to be moved to an extreme position relative to the U bracket. In yet another alternate embodiment two angle blades are affixed to the back of the bushing mounting plate which slideably engage the sides of the angle bracket channel which is separate and pivot holes and bolt are provided at one end and a multitude of companionate angle setting holes and bolt are provided at the opposite end. The user selects the desired angle and pins the aligned angle setting holes with the associated bolt.

Rapid identification of the busing wells as cables are attached is another improvement offered. Especially when changing out equipment the linemen will set the lines and bushing aside or in the hole out of their way. Rapid identification of the cable may be provided by numbers on the bushing mount. This may be accomplished by a bushing identification means affixed to the bushing mounting plate assembly or a collar plate which slides over the wells and is companionate with the bushing attaching means which may be as simple as bolts that pass through the collar plate to the mounting plate.

Often lineman are relegated to ground testing cables individually on a two well bushing and then setting them aside as they test other cables. That method gives rise to the risk of tested cables becoming energized after they have been tested and set aside. The use of an at least three well bushing presents the ability to test and park cables fully grounded. Further presented is the method of grounding a four well bushing and testing/parking the cables of a three phase system. Through the efforts of this inventor this method of ground bonding all phases of a multi phase system has been approved by safety standards committee of a major power distribution company. When first exposed to this method some personnel in the power distribution industry have expressed concern that if an energized line is introduced to the bushing that it would energize all other cables present on the bushing. This concern is valid but if an energized line is introduced it would be faulted out by the ground and indicates that there is a major problem with line configuration at other connections which should be addressed before any further maintenance is preformed. The total safety improvement of having all phases verifiably grounded at a single location is readily perceived by linemen. The advantage of this method may be expanded to involve an even greater number of power lines.

DETAILED DESCRIPTION OF THE DRAWINGS

Figure 1:
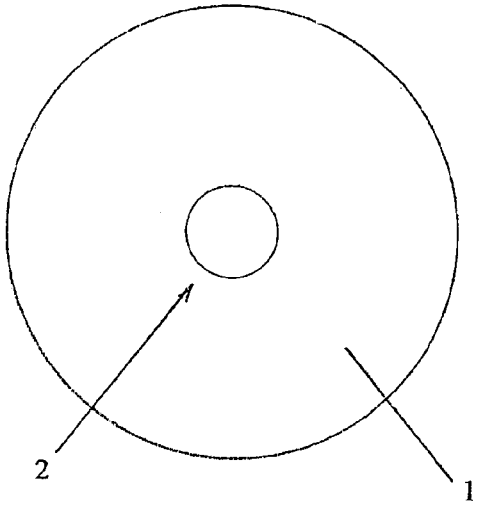
FIG. 1 is a top view of the U bracket flange.

FIG. 1 shows a top view of U bracket flange 1 which has first carriage bolt aperture 2 centrally located.

Figure 2:
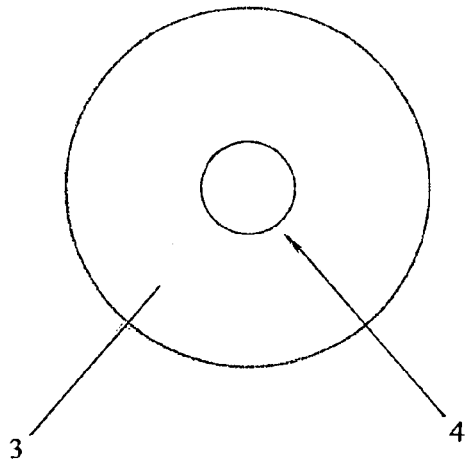
FIG. 2 is a top view of the U bracket spacer.

FIG. 2 shows a top view of U bracket spacer 3 which has second carriage bolt aperture 4 centrally located.

Figure 3:
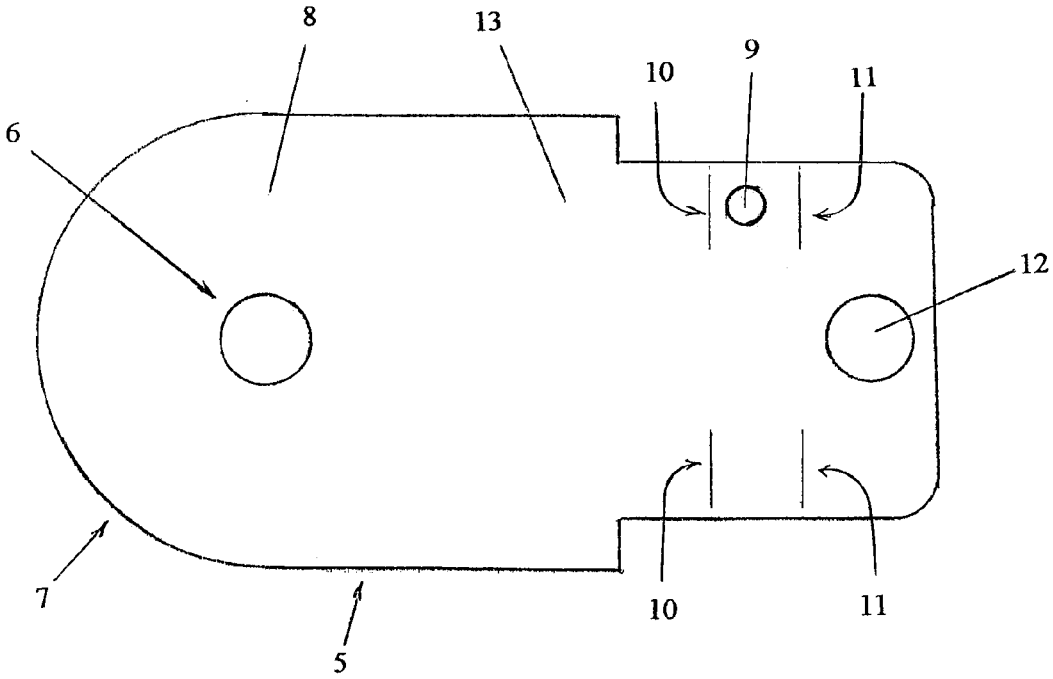
FIG. 3 is a top view of the position fixing bracket blank prior to forming on the indicated break lines.

FIG. 3 shows a top view of position fixing bracket 5 which has third carriage bolt aperture 6 centered on end radius 7 at first end 8. Bleed grounding attachment aperture 9 is located between forming break line 10 and 11. Eye bolt aperture 12 is shown generally centered and proximal to second end 13.

Figure 4:
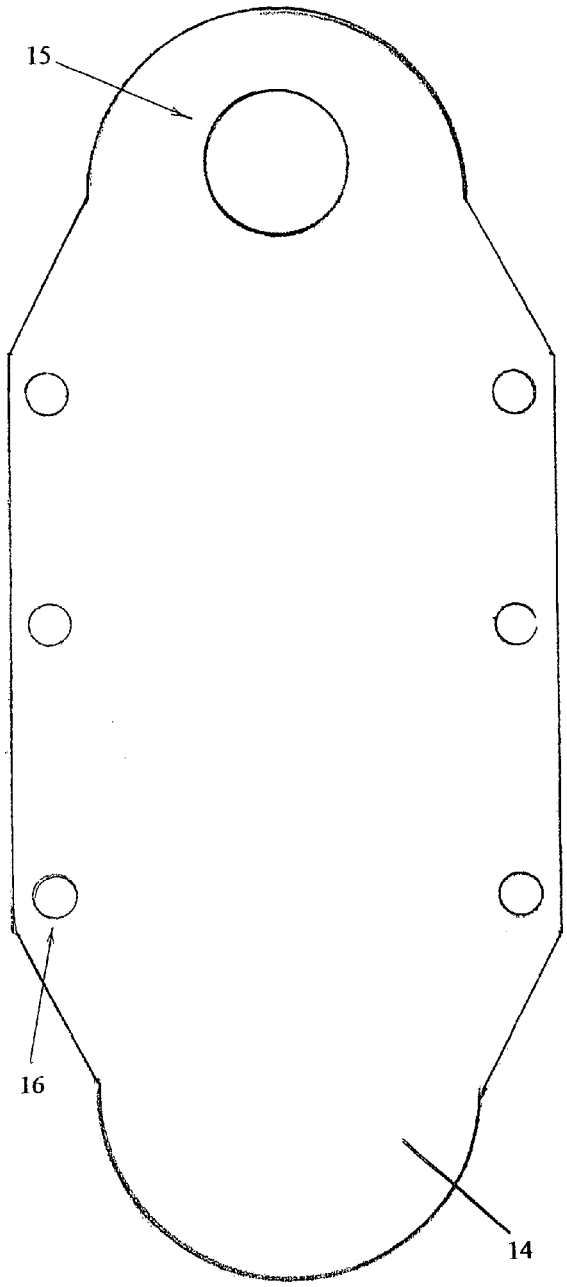
FIG. 4 is a top view of the bushing face plate.

FIG. 4 shows a top view of bushing mounting plate 14. Shown at one end of bushing mounting plate 14 is carriage bolt head aperture 15 and on opposing sides multiple bushing mounting apertures 16.

Figure 5:
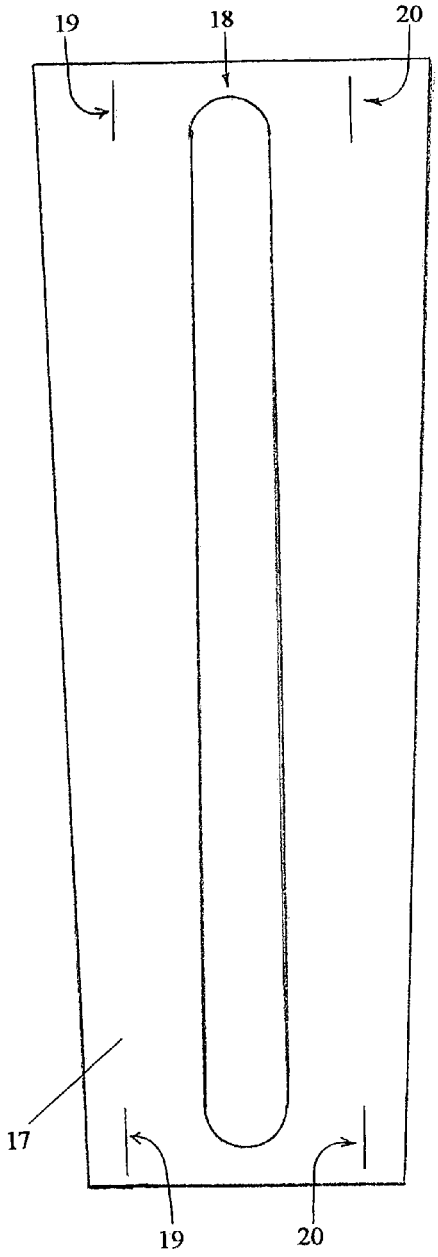
FIG. 5 is a front side view of the angle channel bracket blank prior to forming on the indicated break lines.

FIG. 5 shows a top view of angle bracket channel 17 prior to forming. Carriage bolt elongated aperture 18 is shown along with forming break lines 19 and 20.

Figure 6:
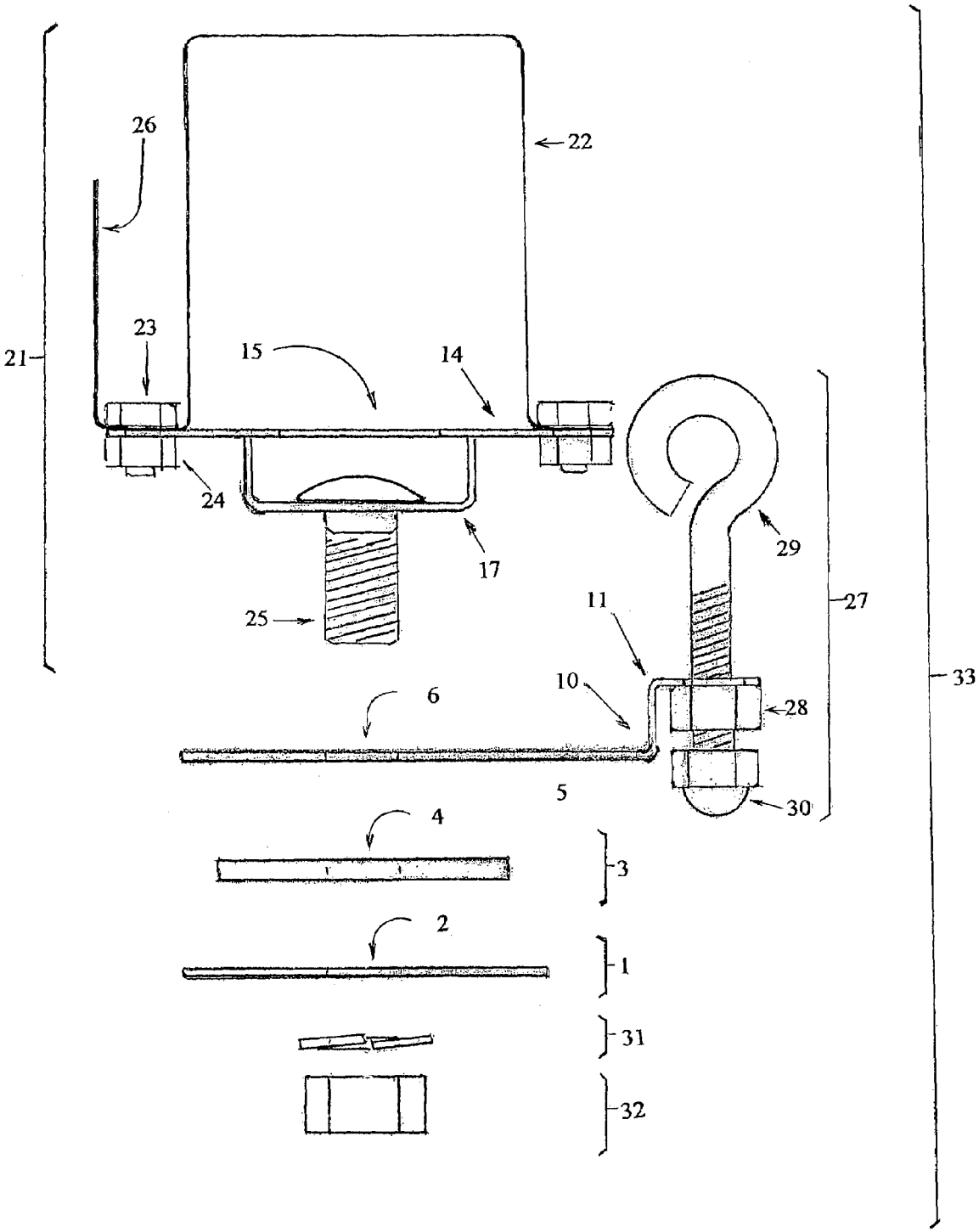
FIG. 6 is an exploded view of the mounting plate assembly with assembled groups within.

FIG. 6 Shows an exploded end view of bushing mounting plate assembly 33. Angle bracket channel 17 is shown as formed and affixed to bushing mounting plate 14 and bushing holding loop 22 and number plate 26 are joined by bushing mounting bolts 23 and nuts 24 and carriage bolt 25 is shown engaged in carriage bolt aperture 18 (FIG. 5) having been passed through carriage bolt head aperture 15 and are shown together as assembly 21. Position fixing bracket assembly 27 is shown with position fixing bracket 5 having been formed on break lines 10 and 11. Eye bolt nut 28 is affixed to position fixing bracket 5 and eye bolt 29 is advanced through eye bolt nut 28 and dome nut 30 is advanced on the thread end of eye bolt 29. Position fixing bracket assembly 27 is aligned on carriage bolt 25 by way of third carriage bolt aperture 6 as is U bracket spacer 3 by way of second carriage bolt aperture 4 and as is U bracket flange 1 by way of first carriage bolt aperture 2. Lock washer 31 is shown in alignment with carriage bolt 25 as is carriage nut 32.

Figure 7:
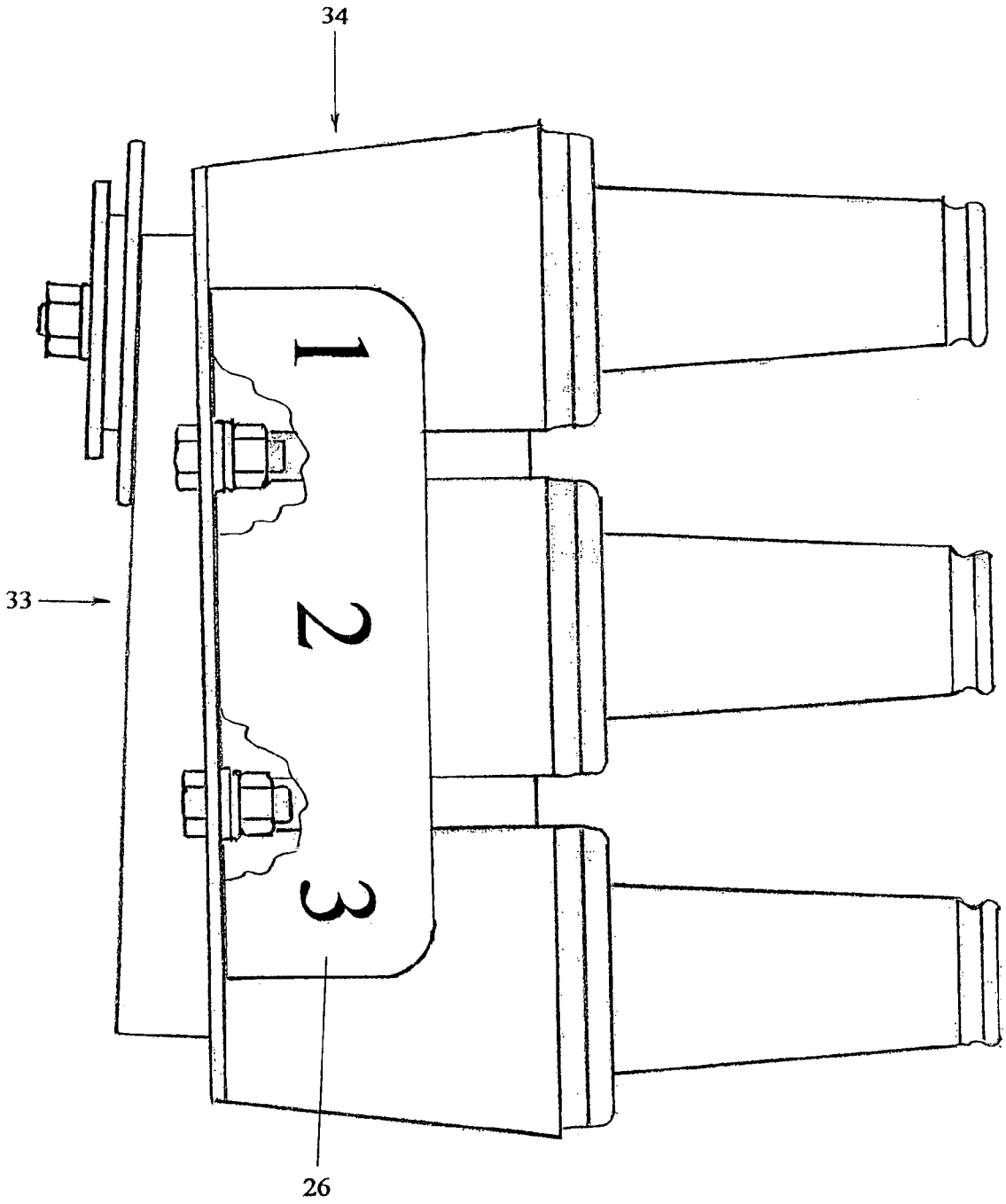
FIG. 7 is a side view of the mounting plate assembly including a number plate and a three well bushing.

FIG. 7 shows a side view of bushing mounting plate assembly 33 with number plate 26 shown for clarity and three well bushing 34 mounted on it.

Figure 8:
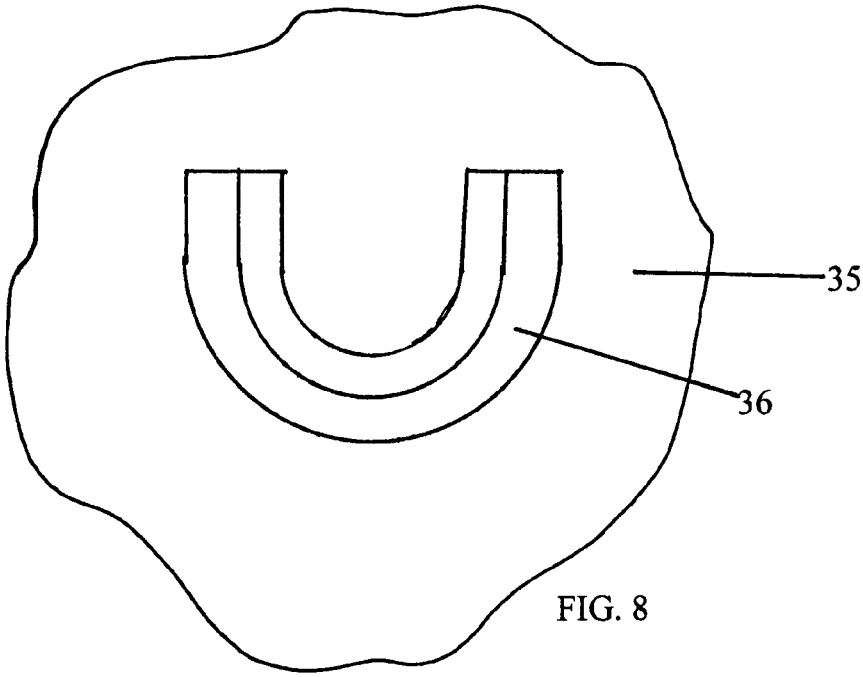
FIG. 8 is a front view of a U bracket affixed to the surface of a power distribution device.

FIG. 8 shows a front view of a U bracket 35 affixed to the surface 36 of a power distribution device.

Figure 9:
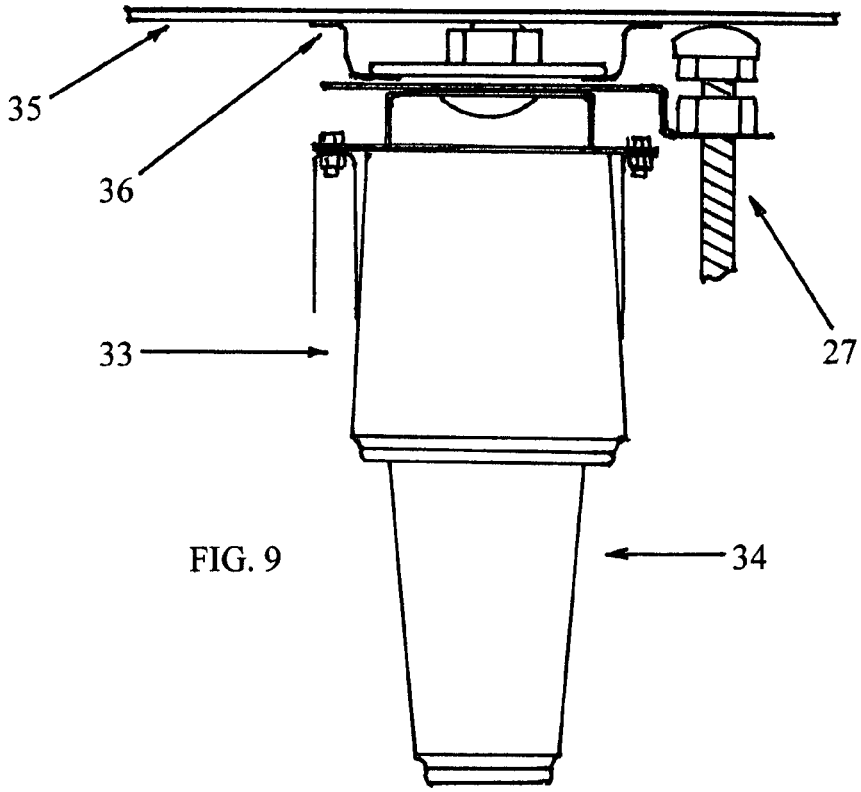
FIG. 9 is a top view of the mounting plate assembly with a three well bushing mounted in the U bracket on the surface of a power distribution device.

FIG. 9 shows a top view of bushing mounting plate assembly 33 with three well bushing 34 mounted in U bracket 36 with position fixing bracket assembly 27 (FIG. 6) engaged on surface 35.

The embodiment described in this specification and shown in the drawings are not intended as limitations on the invention. Those skilled in the art can envision variations of the concept to adapt to specific needs in peculiar situations and the general usefulness of the concept as temporary mounting means vary as power distribution equipment maintenance common practices evolve.

I claim:

1. An apparatus for grounding, bonding and/or parking power distribution cables which is adapted to be removeably mounted on a U bracket affixed to a surface of and commonly utilized on transformers and especially pad mount underground equipment, switching cabinets and other power distribution equipment comprising;

a power distribution device with at least one U bracket affixed to a surface;

at least two electrical conductive cables;

a multi well feed through bushing;

said cables having end connectors companionate with wells of said bushing;

a bushing mounting plate assembly;

said bushing mounting plate assembly comprising:

a bushing mounting plate;

a U bracket mounting means slideably affixed to said bushing mounting plate further including a position fixing means;

a bushing mounting means;

said bushing mounted to said bushing mounting plate by said bushing mounting means;

a bushing identification means affixed to said bushing mounting plate or said bushing mounting means;

said U bracket mounting means mounted into said U bracket and said position fixing means engaged to said U bracket or its surrounding surface; and said cables each mounted in a separate well of said feed through bushing.

2. The apparatus of claim 1 wherein:

said bushing mounting plate assembly holds said bushing at a predetermined angle other than parallel to said U bracket or its surrounding surface.

3. The apparatus of claim 1 wherein:

said bushing mounting plate extends beyond one end of said bushing.

4. The apparatus of claim 1 wherein:

said bushing mounting plate assembly holds said bushing at a predetermined angle other than parallel to said U bracket or its surrounding surface; and said bushing mounting plate extends beyond one end of said bushing.

5. An apparatus for grounding, bonding and/or parking power distribution cables which is adapted to be removeably mounted on a U bracket affixed to a surface of and commonly utilized on transformers and especially pad mount underground equipment, switching cabinets and other power distribution equipment comprising;

a power distribution device with at least one U bracket affixed to a surface;

at least two electrical conductive cables;

a multi well feed through bushing mounted to a bushing mounting plate assembly;

said multi well bushing having at least two wells adaptive to receive cable end terminations commonly utilized in power distribution and generally two, three or four wells which are bonded in electrical communication with each other;

said bushing mounting plate assembly comprising:

a carriage bolt with lock washer and nut;

a U bracket mounting means comprising:

a U bracket flange having a thickness and having a circumference generally greater that the U opening of said U bracket and less than the distance between the U bracket sides and defining a centrally located aperture which accommodates the shank of said carriage bolt;

a U bracket spacer having a thickness generally greater than the thickness of said U bracket's material and having a diameter generally less than the width of the U opening of said U bracket defining a centrally located aperture which accommodates the shank of said carriage bolt;

a bushing mounting plate whose profile approximates the foot print of said bushing's base having a front, a back and thickness having regions which extend past the true foot print of said bushing which define bushing mounting apertures and further defining an aperture adaptive for said carriage bolt head to pass through generally centered relative to the mounted position of an end well of said bushing;

bushing mounting means which engage said bushing and align with said bushing mounting apertures;

fasteners adaptive to said bushing mounting means and said bushing mounting apertures;

an angle bracket channel with a base and two sides and a first and a second end and a length;

said sides are generally ninety degrees relative said base and parallel relative to each other length wise and height wise said sides are of one height at said first and of a different height at said second end said base of said angle bracket channel defining an elongated aperture whose width slideably engages the square head base of said carriage bolt and generally centrally located relative to the width of said base;

said angle bracket channel affixed to the back of said bushing mounting plate a position fixing bracket comprising:

a position fixing bracket plate;

an eye bolt;

an eye bolt nut;

an eye bolt dome nut;

said position fixing bracket having a first end, a second end, width and a length, said position fixing bracket width equal to or greater that the diameter of said U bracket flange, said position fixing bracket first end's periphery being a 180 degree convex generally consistent radius about equal to one half said position fixing bracket width, said position fixing bracket second end being unitary with said first end and generally being rectangular, said position fixing bracket second end opposite said first end being formed perpendicular to its center line about two opposite break lines generally 90 degrees forming a step profile wherein the first break line is a greater distance from the center point of the radius of said first end than half the width of said bushing mounting plate at its widest point, said position fixing bracket first end defining an aperture adaptive to receiving said carriage bolt's shank, said position fixing bracket second end raised step portion defining a centrally located eye bolt aperture adaptive to receive said eye bolt's shanks, said position fixing bracket second end defining an aperture adaptive to receive a voltage bleeding means;

said eye bolt nut affixed to said position fixing bracket second end aligned with said eye bolt aperture;

said eye bolt advanced through said eye bolt nut;

said eye bolt dome nut affixed to the lead end of said eye bolt; and said carriage bolt passed through said bushing mounting plate's carriage bolt aperture and passed through said angle bracket channel's elongated aperture slidably engaging said carriage bolt's square head base, said position fixing bracket engaged on said carriage bolt with its step toward said bushing mounting plate, said U bracket spacer engaged on said carriage bolt, said U bracket flange engaged on said carriage bolt, said lock washer engaged on said carriage bolt said carriage bolt nut advanced on said carriage bolt;

said bushing affixed to said bushing mounting plate by said bushing mounting means;

a bushing identification means attached to said bushing mounting plate assembly or said bushing mounting means;

said U bracket mounting means mounted into said U bracket and said position fixing means engaged to said U bracket or its surrounding surface; and said cables each mounted in a separate well of said feed through bushing.

6. The apparatus of claim 5 wherein:

said bushing mounting plate assembly further comprises:

the sides of said angle bracket channel not being permanently affixed directly to said bushing mounting plate;

a first and second angle blade affixed to back of said bushing mounting plate which are parallel with and slide against the sides of said angle bracket channel;

the first end of said first and second angle blade and said angle bracket channel defining aligning pivot apertures;

the second end of said first and second angle blade and said angel bracket channel sides defining a multitude of companionate angle setting apertures;

a pivot bolt; and an angle setting bolt.

7. The apparatus of claim 5 wherein:

said angle bracket channel and said elongated aperture extends beyond one end of said bushing.

8. The apparatus of claim 5 wherein:

said bushing mounting plate assembly further comprises:

the sides of said angle bracket channel not being permanently affixed directly to said bushing mounting plate;

a first and second angle blade affixed to back of said bushing mounting plate which are parallel with and slide against the sides of said angle bracket channel;

the first end of said first and second angle blade and said angle bracket channel defining aligning pivot apertures;

the second end of said first and second angle blade and said angel bracket channel sides defining a multitude of companionate angle setting apertures;

a pivot bolt;

an angle setting bolt; and said angle bracket channel and said elongated aperture extends beyond one end of said bushing.

* * * * *